US008684201B2

(12) United States Patent
Berkovitch et al.

(10) Patent No.: US 8,684,201 B2
(45) Date of Patent: Apr. 1, 2014

(54) DRINKING CONTAINER, VENT SYSTEM AND METHOD

(75) Inventors: Amikam Berkovitch, Shenley (GB); Tamir Tirosh, Menahemia (IL)

(73) Assignee: Coralinda Trading Corporation, Zurich (CH)

( * ) Notice: Subject to any disclaimer, the term of this patent is extended or adjusted under 35 U.S.C. 154(b) by 957 days.

(21) Appl. No.: 11/695,030

(22) Filed: Apr. 1, 2007

(65) Prior Publication Data

US 2009/0071926 A1 Mar. 19, 2009
US 2013/0220962 A9 Aug. 29, 2013

Related U.S. Application Data

(63) Continuation of application No. PCT/IL2005/001067, filed on Oct. 7, 2005.

(60) Provisional application No. 60/617,375, filed on Oct. 8, 2004.

(51) Int. Cl.
*A61J 9/04* (2006.01)

(52) U.S. Cl.
USPC ..... 215/11.5; 215/11.4; 220/714

(58) Field of Classification Search
USPC ..... 215/11.2, 11.4, 11.5, 902, 11.1; 220/714, 745, DIG. 27; 137/526
See application file for complete search history.

(56) References Cited

U.S. PATENT DOCUMENTS

| | | | | | |
|---|---|---|---|---|---|
| 2,814,202 | A * | 11/1957 | Frans | 374/150 |
| 3,174,641 | A * | 3/1965 | Kitterman | 215/260 |
| 3,247,360 | A * | 4/1966 | Ponder | 219/436 |
| 3,626,764 | A * | 12/1971 | Corsette | 73/492 |
| 4,919,983 | A * | 4/1990 | Fremin | 428/35.7 |
| 5,791,503 | A * | 8/1998 | Lyons | 215/11.5 |
| 5,806,528 | A * | 9/1998 | Magliochetti | 128/897 |
| 7,044,316 | B1 * | 5/2006 | Hsu | 215/11.1 |
| 2004/0089626 | A1 * | 5/2004 | Pyun | 215/11.5 |
| 2005/0258124 | A1 * | 11/2005 | Brown et al. | 215/11.1 |

* cited by examiner

*Primary Examiner* — Sue A Weaver
(74) *Attorney, Agent, or Firm* — Deborah Gador

(57) ABSTRACT

The present invention relates to a drinking apparatus including a vent system that removably connects to a drinking container. The vent system is used to create a variety of leak resistant drinking containers, such as toddler drinking cups, baby bottles, and other drinking containers. The vent system includes a substantially rigid disc portion and base portion, the base portion including base air vent channels merging into an integral one-way valve. The vent system provides passage for air from the exterior of the bottle to the interior of the bottle, but it does not allow liquid to exit the bottle via the vent system. An optional anti-bubble tube may be used with the vent system to provide for air entering the inverted container to reach an air pocket formed in the bottom portion of the container.

13 Claims, 13 Drawing Sheets

DRINKING CONTAINER, VENT SYSTEM AND METHOD

RELATED APPLICATIONS

This application is a continuation of PCT Patent Application number PCT/IL2005/001067 (designating the USA) having an international filing date of Oct. 7, 2005, which claims the benefit of U.S. Provisional Patent Application No. 60/617,375 filed on Oct. 8, 2004.

FIELD OF THE INVENTION

The present invention relates to a drinking container and method of providing flow through the container for use with leak resistant and non-spill containers, such as toddler drinking cups and baby bottles.

DESCRIPTION OF RELATED ART

Specialized baby bottles are manufactured with features that are designed to attempt to reduce colic symptoms in infants from zero months to approximately four months. Notably, U.S. Pat. Nos. 5,570,796 and 5,779,071 state that their designs eliminate the mixing of air into the formula as this increases the risk of colic symptoms. Also, a bottle that requires a child older than four months to exert too much "sucking" action on the nipple of the bottle may result in an increased likelihood of the child developing an ear infection.

The apparatus described in U.S. Pat. Nos. 5,570,796 and 5,779,071 includes a reservoir tube having a tube portion in combination with a reservoir, which acts as a liquid trap. An insert used in conjunction with the reservoir tube provides passage for air from the exterior of a bottle to the interior of the bottle. When the bottle incorporating the features of these patents is fully inverted, the reservoir (liquid trap) contains the liquid from inside the reservoir tube, and prevents the liquid from entering an opening of the insert, since the opening of the insert is above the level of the liquid contained in the reservoir. It is important to note that the volume of the reservoir is larger than the volume of the tube portion, and thus, the liquid may be fully contained in the liquid trap under a narrow window of operating conditions. However, the bottle cannot be filled with liquid that would reach higher in the bottle than the opening of the insert since, when the bottle is inverted, liquid would go directly into the air vent.

On the other hand, since these bottles are fully vented, when turned upside down, liquid flows freely through the liquid outlets, without the need for sucking by a baby. This can be problematic as the liquid spills freely if the bottle is tilted, and even if the baby falls asleep, the liquid keeps flowing, which can cause the child to choke.

Furthermore, the apparatus described in U.S. Pat. Nos. 5,570,796 and 5,779,071 require detailed cleaning of their many needed parts and accessories. Unfortunately, many of the parts have interior and remote regions requiring cleaning with a modified pipe cleaner or the like. Even with such measures, it is difficult to ensure that the interior regions are clean, and most caretakers are not interested in such a detailed and extensive cleaning protocol. In addition, it is difficult to visually inspect the interior regions to ascertain their cleanliness.

Moreover, the apparatus described in U.S. Pat. Nos. 5,570,796 and 5,779,071 suffer from leakage when the bottle is overfilled since then the reservoir tube and the liquid trap described therein become filled with liquid beyond the capacity of the liquid trap, allowing liquid to enter the insert and eventually to the exterior of the bottle. Additionally, the apparatus described in these patents suffers from leakage when the bottle is squeezed, if the nipple attached to the bottle is squeezed, when the bottle is shaken to mix a formula, if the liquid is heated to above 45° C., or if the bottle is subjected to changes in atmospheric pressure, as liquid can flow out through the air inlet passages in these cases, as well.

One solution to some of these problems is shown in PCT publication WO 2004/075810 to Pyun. This application describes a nursing bottle having an air intake unit for allowing external air to be introduced into a body of the nursing bottle while adjusting the amount of external air introduced into the body. The air intake unit includes upper and lower partition plates, and an air inlet tube. The top partition plate includes an air inlet slot and is formed of plastic while the bottom partition plate, which serves to cover and complete the air inlet slot, is made of silicon and equipped with a first check valve for preventing milk from flowing backwards through the air passage. This structure is problematic in that, under pressure applied to close the nipple onto the air inlet unit, the silicon of the bottom plate may deform so as to fill or partially block the air inlet slot in the upper plate, thereby interfering with the free flow of air into the bottle.

The air inlet tube is coupled to a bottom surface of the lower partition plate in such a manner that air introduced into the air intake slot of the upper partition plate is introduced into the body of the bottle when external suction force is applied to the air inlet tube. A second check valve is coupled to the air inlet tube. The first check valve permits air to enter the bottle, and the second permits steam and hot gases to escape from the bottle. Thus, although the Pyun publication states that the second check valve is for preventing milk from flowing backwards, it cannot do so alone since it opens in the direction of the air intake slot to permit the release of hot gases. In practice, the air inlet tube serves to prevent leakage of liquid through the second valve, as it acts as a liquid reservoir, as in the patents described above. Thus, this device cannot be used without the air inlet tube, as liquid would flow out through the air inlet slot.

SUMMARY OF THE INVENTION

The present invention relates to a drinking apparatus comprising a vent system that removably connects to a bottle or a drinking container. The vent system comprises a disc portion, and a base portion having a single one-way valve integrally formed with the base portion. The vent system provides passage for air from the exterior of the container to the interior of the container. The valve allows the air to enter the container, but it does not allow liquid to exit the container via the vent system. Multiple embodiments for the base portion are described herein, including an embodiment with a duck-bill valve.

An optional anti-bubble tube may be used with the vent system. The anti-bubble tube provides for air entering the inverted container to reach an air pocket formed in the bottom portion of the container which, during the use of the container, is raised above a nipple or a spout of the container. The air pocket is created by the emptying of the container through the nipple or the spout by the user. By providing passage for the air directly to the air pocket, the incoming air is not allowed to mix with the liquid in the container and create air bubbles in the liquid.

The vent system may be used in a variety of leak resistant and essentially non-spill drinking containers, such as toddler drinking cups, baby bottles, adult sport drink containers, and other drinking containers. It will be appreciated that the optional anti-bubble tube is only for use in baby bottles, and other containers with the vent system of the invention provide leak resistant and non-spill containers even without the tube.

The vent system, the anti-bubble tube and the valve together act as a "diving bell", and generally prevent liquid from entering the anti-bubble tube when the drinking container is in a substantially upright position. This is due to the fact that air is trapped in the anti-bubble tube with no escape until the valve is opened, i.e., the trapped air acts as a barrier preventing liquid from entering the anti-bubble tube. The diving bell effect is created by the user of the container when the user places the vent system (with the anti-bubble tube attached) into the container. The diving bell function allows the user to vigorously shake the container without leakage or to fill the container with boiling water without leakage. The container may also be completely filled with liquid, i.e., the container may be filled without limitation.

When the container is inverted and liquid exits from the container, as soon as a vacuum force is created inside the container, the valve is opened and air enters the container. As air is drawn into the container, the valve releases the "new" air into the anti-bubble tube and into the volume of trapped air. This "new" air may displace some of the trapped air, thus forcing the trapped air through the anti-bubble tube. In this position, the "diving bell" effect is not maintained in the anti-bubble tube. In any event, the anti-bubble tube is shaped and coupled to the base portion of the vent system in such a way as to allow only a small amount of liquid to enter the anti-bubble tube. Thus, the liquid generally does not cover the valve. However, even if liquid covers the valve, the valve prevents the liquid from entering the air inlet channels of the vent system and, despite the absence of the diving bell effect, the bottle still operates in a leak-free manner.

The optional anti-bubble tube is important for use by newborns, since they are at a greater risk for developing colic symptoms from swallowing air. However, as infants grow, this invention allows the user to remove the anti-bubble tube and still retain a leak resistant vent system.

The vent system allows an infant drinking from a bottle of the present invention to easily drink from a nipple or spout attached to the bottle without appreciably increasing the vacuum force inside the bottle. At the same time, the valve of the vent system reduces the likelihood of leakage of liquid from the bottle via the vent system when the bottle is in an inverted or sideways position, since the valve prevents the flow of liquid into the vent system. The valve is designed such that increased exertion to create a high degree of suction force is not necessary for liquid to flow from the bottle and, thus, the risk of causing a middle ear infection in the user from such over exertion is reduced. On the other hand, suction is required in order to provide liquid outflow, which simulates breast feeding and prevents spilling of the liquid when the bottle or container is upside down.

According to the present invention, a small quantity of liquid exits the container through the nipple or spout when the container is inverted or placed at an angle, creating a minimal vacuum force in the container. When a child sucks on the nipple or spout, the vent system provides venting to the atmosphere surrounding the container and provides for operation with minimal vacuum. This minimal vacuum force created in the container of present invention as the liquid is exiting the container draws air into the container from the surrounding atmosphere until equilibrium between the atmosphere and the interior of the container is created. Thus, the container of the invention requires an added sucking force to be applied by the user of the container to receive liquid from the container which may emulate the process of breast feeding. However, no appreciable vacuum force is created in the container during use of the container due to the venting.

As used herein, "leak free" means that the container is free from leaks through the vent system. Since the vent system provides venting, the valve is necessary to prevent leakage therethrough. All of the embodiments of the present invention operate in a leak free manner.

As used herein, "non-spill" refers to spillage via the nipple or the spout of the container. Certain embodiments of the present invention operate in a non-spill manner.

The vent system of the present invention is particularly simple to clean, since the base portion and the disc portion do not include interior or remote regions that are inaccessible without specialized cleaning equipment. Rather, all regions of the base portion and the disc portion are readily accessible. Thus, the vent system provides full access to various components of the vent system for cleaning. Additionally, the various components of the vent system may be visually inspected for cleanliness.

The vent system of the present invention attaches to certain readily available containers in the baby bottle industry. In other embodiments of the present invention, the vent system may be used in conjunction with a "sippy cup" and spout for use by toddlers. The sippy cup may also include a flexible spout. In addition to baby bottles and sippy cups, the apparatus of the present invention may be used with non-spill containers for people of all ages. For example, bicyclists and other athletes and sports participants may benefit from using a substantially leak-free, non-spill container.

BRIEF DESCRIPTION OF THE DRAWINGS

The present invention will be further understood and appreciated from the following detailed description taken in conjunction with the drawings in which.

DETAILED DESCRIPTION OF THE PREFERRED EMBODIMENTS

Figure 1:
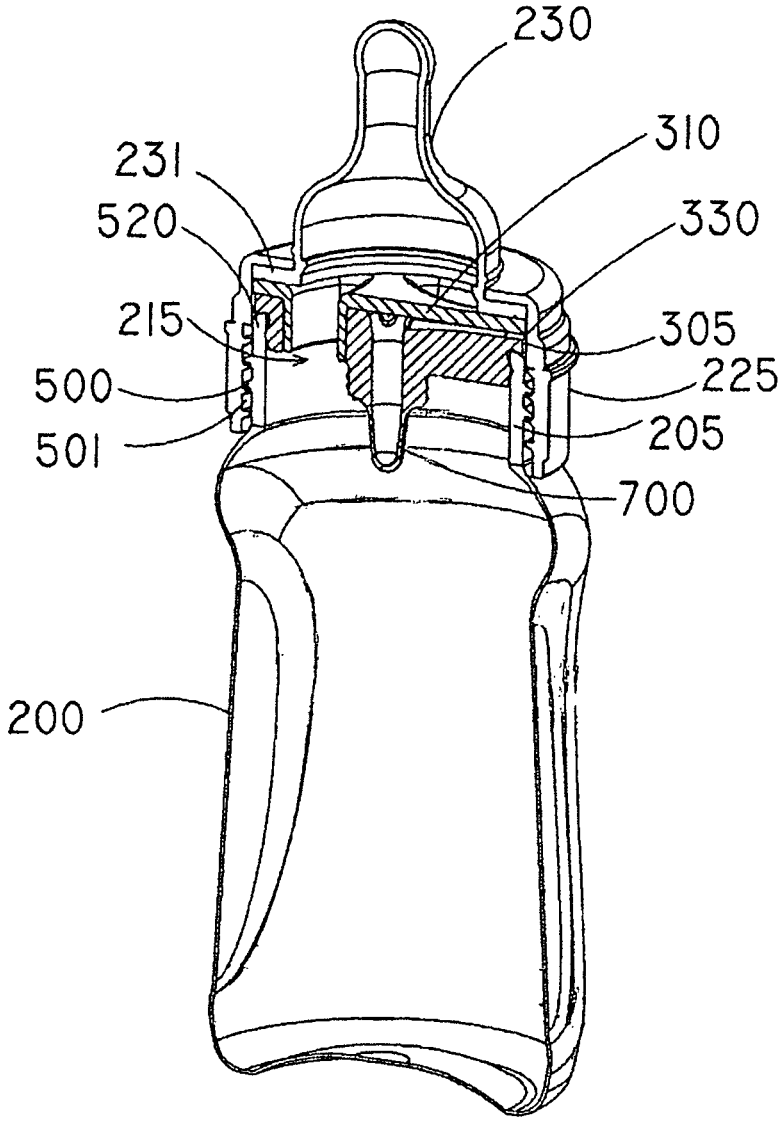
FIG. 1 is a sectional view of a bottle having a vent system constructed and operative in accordance with a first embodiment of the present invention.

The present invention is directed to a vent system that may be used to provide leak resistant drinking containers, such as a baby bottle, a sippy cup, sports bottles, or other non-spill drinking vessels used by adolescents and adults. The present invention also relates to a drinking apparatus comprising a vent system that removably connects to a bottle or a drinking container. The vent system includes a disc portion and a base portion for closing the drinking container. The disc portion and the base portion operate together to allow liquid to flow to a nipple or a spout of the container and to also allow air to enter the container. The base portion includes a one-way valve, integrally formed with the base portion. The valve includes an opening to allow air to pass from the atmosphere surrounding the drinking container to the interior of the drinking container. This allows liquid to freely flow from the container under minimal vacuum, without the user applying more suction force than in breast feeding. The vent system is designed such that increased exertion to create a high degree of suction force is not necessary for liquid to flow from the bottle, and thus the likelihood of causing an ear infection in the user from such over exertion is reduced. At the same time, the valve prevents liquid from the interior of the drinking container from leaking out through the vent system.

An optional anti-bubble tube may be used with the vent system, to provide for air entering the inverted container to reach an air pocket formed in the bottom portion of the container during use of the container. By providing a passage, via the anti-bubble tube, for the air directly to the air pocket, the air is not allowed to mix with the liquid in the container and create air bubbles in the liquid.

The vent system removably connects to a bottle or other drinking container. Generally, the vent system is held into or onto the drinking container via a collar. The disc portion and the base portion are complimentary in shape and cooperate to form the air vent channels that merge into the valve, and provide an air passage into the container from the atmosphere surrounding the drinking container via the space between the container and the collar.

The vent system is easily assembled and disassembled by the user. Importantly, the base portion and disc portion, when disassembled, are easily cleaned, since nearly all of their surfaces which form the air vent channels and liquid openings are fully accessible and may be cleaned without any specialized equipment.

Multiple embodiments for the base portion are described herein. In general, the base portion comprises the valve, a plurality of base liquid openings, and a plurality of base vent channels. The base vent channels are a grooved or a recessed portion of the base portion extending between the valve and the periphery of the base portion where vent channel openings are located. The valve is essentially hollow and includes an opening or slit that provides passage for air into the interior of the container. The valve communicates with the base vent channels to allow air to enter the container from the exterior. When the disc portion is placed on the base portion, the air vent channels are fully defined by the base vent channels and a bottom surface of the disc portion, and, thus, the air vent channels are sealed from the liquid openings. The disc portion is formed of a substantially rigid material, while the base portion is formed of silicon or other flexible, sterilizable material, so the base vent channels cannot be blocked by the disc portion.

The exact shape and structure of the base liquid openings may vary so long as they provide for the liquid to flow from the drinking container to the nipple and allow the vent system to operate. The shape of the base liquid openings may be, for example, triangular, ovular, or kidney-shaped. The base liquid openings are defined by throughgoing base liquid opening channels that extend through the base portion.

The disc portion also comprises a plurality of disc liquid openings to allow liquid to pass to the interior of the nipple. The plurality of disc liquid openings cooperate with the plurality of base liquid openings to create the liquid openings. The base liquid openings and the disc liquid openings are preferably complimentary in shape and arranged such that the disc liquid openings seat inside the base liquid openings. The complimentary shape of the base liquid openings and disc liquid openings provides stability to the vent system and seals liquids from the air vent channels. This sealing prevents liquids from entering the air vent channels and reduces leaking.

According to one embodiment of the invention, each disc liquid opening includes a descending member that defines the disc liquid opening and extends below a bottom surface of the disc portion. This descending member is received by the base portion, i.e., the descending member seals flush against the base liquid opening channels of the base member. This sealing of the complementary disc liquid opening and the complementary base liquid opening stabilizes the disc portion on top of the base portion and prevents liquid from entering the air vent channels.

The present invention will now be described with reference to FIG. 1, which shows a drinking apparatus including a container 200 incorporating a vent system 215 constructed and operative in accordance with a first embodiment of the present invention. In the illustrated embodiment, container 200 is a baby bottle, although one of ordinary skill in the art may adjust the dimensions of vent system 215 to fit a larger sippy cup container or to an even larger adult sized drinking container. Vent system 215 comprises a base portion 305 and a disc portion 310. The vent system 215 provides for air to enter the container 200 to compensate for the liquid exiting the container and thus prevent more than a minimal vacuum from forming within the container 200.

A collar 225 screws down over the top of the vent system 215 and around a neck 205 of the container. The collar 225 holds a nipple 230 in place on top of the vent system 215. A nipple flange 231 may be squeezed by the collar 225 to seal the nipple against disc portion 310 of vent system 215. In the alternative, a lid with a flexible spout, or any other suitable dispensing device, may be used instead of the nipple 230.

This embodiment of the present invention will now be discussed with particular reference to FIGS. 2-4, which show the main components of the vent system 215, namely the base portion 305 and the disc portion 310.

Figure 2:
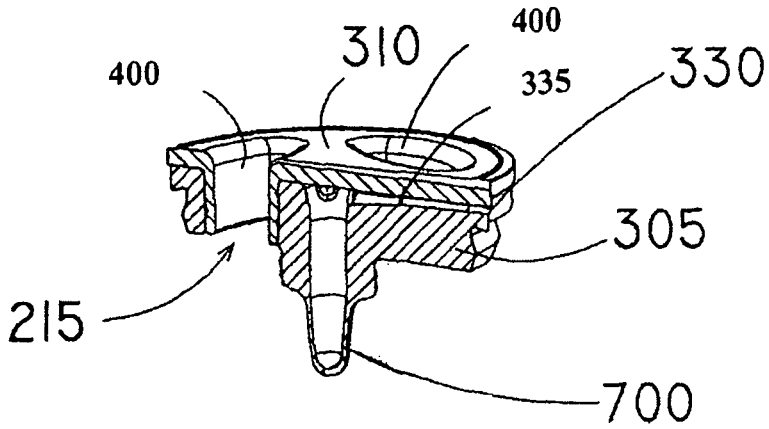
FIG. 2 is a sectional view of the vent system according to the first embodiment.
Figure 3C:
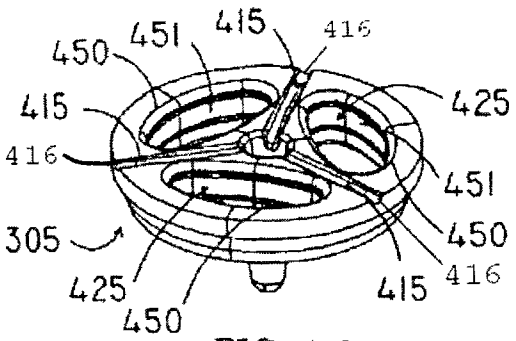
FIGS. 3(A)-3(D) are views of the base portion of the first embodiment.
Figure 3D:
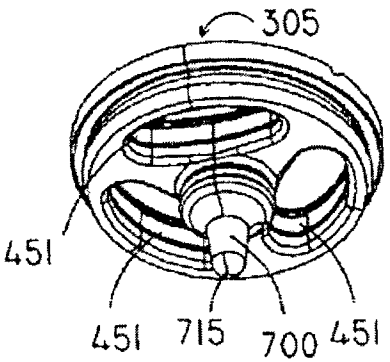
Figure 3A:
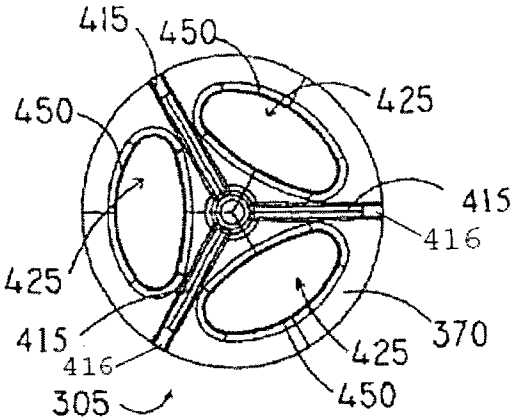
Figure 3B:
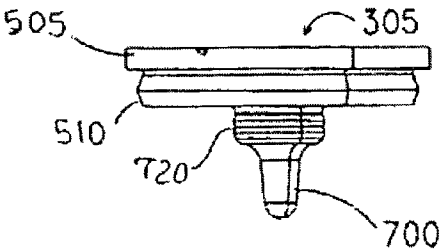
Figure 4A:
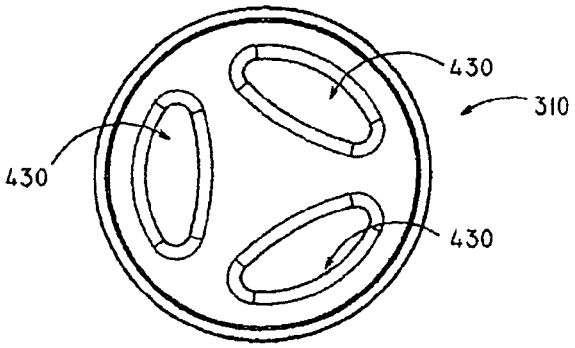
FIGS. 4(A)-4(E) are views of the disc portion.
Figure 4B:
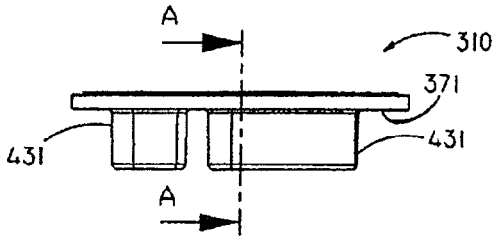
Figure 4D:
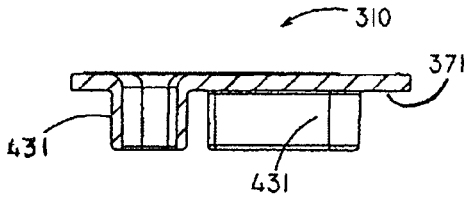
Figure 4C:
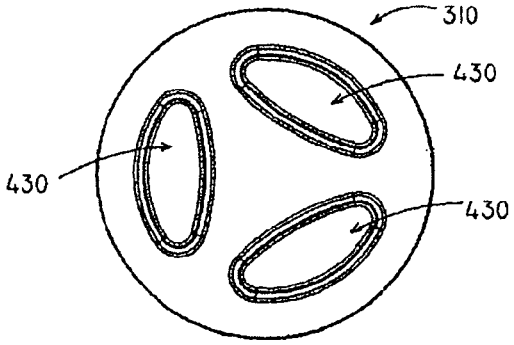
Figure 4E:
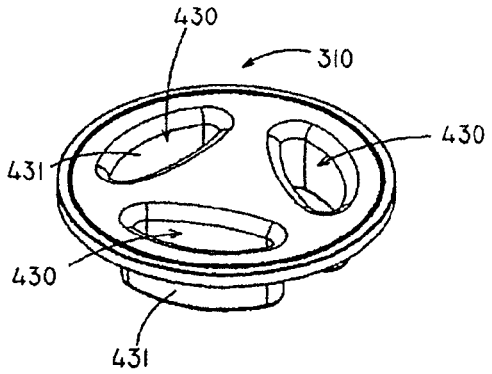

As seen in FIG. 2, the vent system 215 includes the disc portion 310 and the base portion 305. Disc portion 310 is substantially rigid. Disc portion 310 and base portion 305 cooperate to form air vent channels 335 leading from air vent openings 330 in the exterior of vent system 215. The air vent channels 335 merge into a unidirectional valve 700 having an opening or a slit 715, such that air may pass from outside of the container through the vent channel openings 330, through the air vent channels 335, through the valve 700, through slit 715 of the valve and into the container 200. Air from the outside may pass between the threads of the collar and the threads on the exterior of the baby bottle or the sippy cup container to the vent channel openings 330.

The vent system 215 also includes liquid openings 400. The liquid openings 400 allow the fluid in the container, such as the formula, juice, milk, etc., to pass from the bottle or sippy cup through the vent system 215 and to the nipple or the spout. The liquid openings 400 may be of any shape so long as they provide rigidity to the vent system 215 and provide for the fluids to pass through the liquid openings 400.

With reference to FIGS. 3A to 3D, the base portion 305 of the vent system 215 is illustrated in detail. Base portion 305 includes an outer ring 505 and an inner ring 510. The inner ring 510 fits inside of the container 200, while the outer ring 505 sits on a top lip 520 (shown in FIG. 1) of the container 200. Preferably, inner ring 510 is slightly angled to the periphery of the first base portion 305 to create a seal against the inside of the container 200.

Base portion 305 is formed with base vent channels 415. The base vent channels 415 are a grooved or a recessed portion of the base portion 305 that create a channel for air to enter the base portion and ultimately to the valve and the interior of the container. It is a particular feature of the invention that base portion 305 with base vent channels 415 is integrally formed with valve 700, preferably of silicon or other flexible and sterilizable material.

Base portion 305 also includes a plurality of base liquid openings 425. In this embodiment, the base liquid openings 425 are defined by base liquid opening channels 450 that extend through the base portion 305 below a top surface 370 of the base portion 305. The base liquid opening channels 450 have a tubular shape.

Integrally formed with base portion 305 is a one-way valve 700. The valve 700 allows air to enter the bottle to prevent more than a minimal vacuum from forming, but it does not allow liquid to exit the bottle via the vent system 215 and create a leak. The valve 700 includes a valve opening 715 opening into the container as soon as a minimal vacuum is created inside the container. The valve 700 is integral to the first base portion 305, i.e., the first base portion 305 and the valve 700 are formed as a single unit. At a junction between the valve 700 and the remainder of the base portion 305, the base portion includes an indented region 720 (shown in FIG. 5B) for an optional anti-bubble tube 800, described in detail below, to circumscribe and attach to the base portion 305.

The disc portion 310 according to one embodiment is illustrated in detail in FIGS. 4A to 4E. Disc portion 310 includes a planar lower surface 371 adapted to sealingly engage a top surface of base portion 305. Extending through disc portion 310 are a plurality of disc liquid openings 430. Each disc liquid opening 430 includes a descending member 431 that defines the disc liquid opening 430 and extends below the lower surface 371 of the disc portion 310. This descending member 431 of the disc portion 310 is received by the base portion 305. The descending member 431 seals against a surface 451 of the base liquid opening channels 450 of the base portion 305. This also stabilizes the disc portion 310 on top of the base portion 305.

Figure 5:
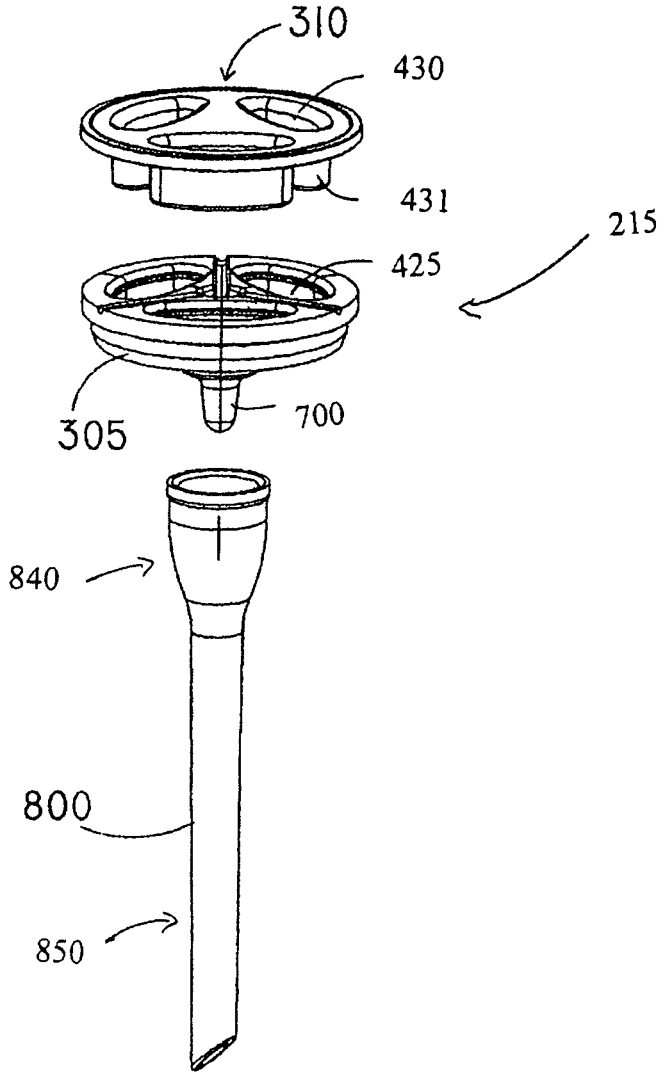
FIG. 5 is an exploded view of the vent system of the first embodiment.
Figures 6A, 6B, 6C, 6D:
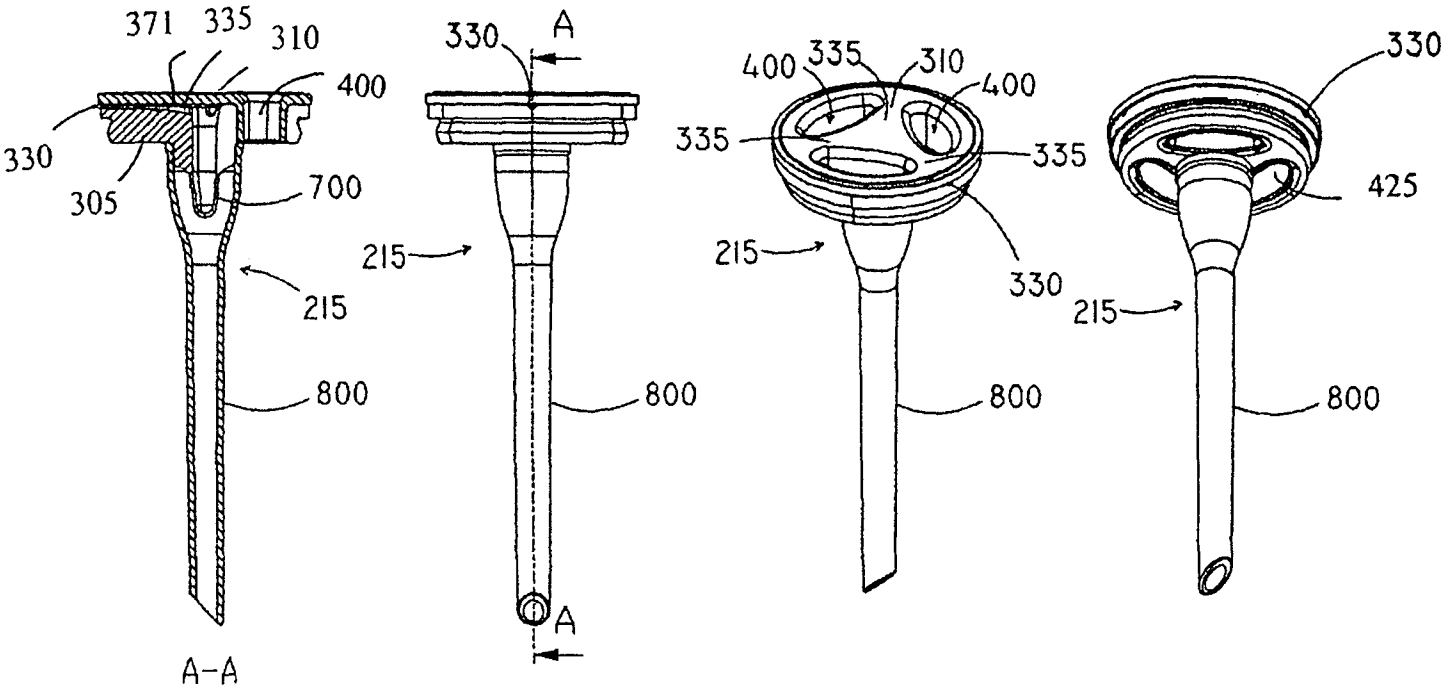
FIGS. 6(A)-6(D) are views of the vent system of the first embodiment.

Assembly of the vent system 215 is shown in FIG. 5. As can be seen, disc portion 310 is placed over base portion 305 with disc liquid openings 430 in registration with base liquid openings 425. An optional anti-bubble tube 800 may be provided, as shown in this embodiment. At a junction between the valve 700 and the remainder of the first base portion 305 the base portion may include an indented region 720 for anti-bubble tube 800 to circumscribe and attach to the base portion 305. The anti-bubble tube 800 extends to nearly the bottom portion of the container 200 and includes an anti-bubble tube opening 815, which provides an outlet for the air from the valve 700 to the interior of the container 200.

The anti-bubble tube 800 comprises a tubular structure that seals the region surrounding the valve 700 and vents through the anti-bubble tube opening 815. The anti-bubble tube 800 is shown comprised of an upper section 840 and a lower section 850, which includes the anti-bubble tube opening 815. The upper section 840 surrounds the valve 700 and the lower section 850 extends nearly the length of the container 200. The anti-bubble tube 800 is a conduit for air from the valve 700 to reach an air pocket formed in the bottom portion of the inverted container 200 during drinking from the container 200, without mixing with the liquid or creating bubbles in the liquid. The volume of the lower section 850 is greater than the volume of the upper section 840. In use, this means that upper section 840 does not serve as a liquid reservoir, so liquid entering the anti-bubble tube from the container may cover the valve opening 715. However, since valve 700 is a one-way valve, no liquid can pass through opening 715 into the air inlet channels. Thus, it will be appreciated that a container with the venting system of the present invention can fulfill its function of introducing air to the container during drinking and preventing leakage through the air inlet passages with or without the anti-bubble tube.

The assembled vent system according to one embodiment of the invention with an anti-bubble tube is illustrated in FIGS. 6A to 6D. The air vent channels 335 are formed when the disc portion 310 is placed on base portion 305. The lower surface 371 of disc portion 310 covers base vent channels 415 and forms and seals a top portion of the air vent channels 335. It is a particular feature of the invention that the disc portion is substantially rigid plastic, while the base portion, including the base vent channels, may be formed of silicon. Thus, even under pressure of the cap, the disc portion cannot be deformed so as to block the vent channels in the base. The base vent channels 415 are fully accessible for cleaning when the disc portion 310 is removed.

In use, air passes in between a threaded region 500 of the neck 205 of the container and a threaded region 501 of the collar (shown in FIG. 1) and enters vent channel openings 330 (shown in FIGS. 1 and 6(A)-(D)) of the vent system 215. This may be accomplished by designing each threaded region such that there is sufficient space for the air to exit or, in the alternative, by creating notches or gaps in the threaded region to provide for air flow.

The liquid openings 400 allow the fluid to pass from the container. The liquid openings 400 are formed by a combination of base liquid openings 425 and disc liquid openings 430. The base liquid openings 425 and the disc liquid openings 430 may vary in structure, although preferably they are complementary to one another.

Figure 7:
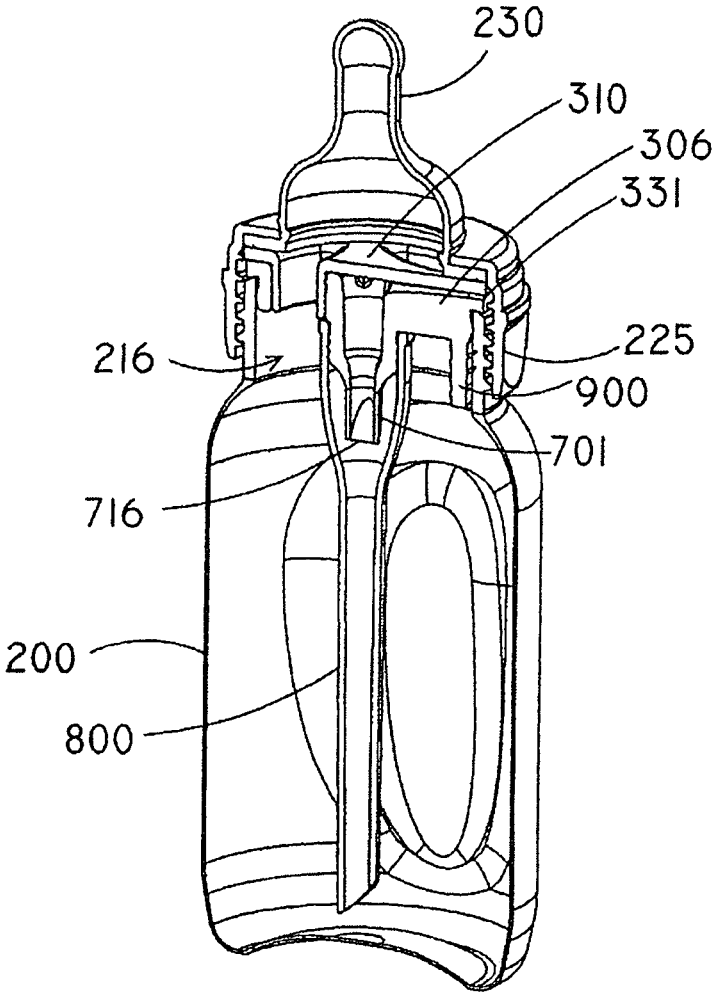
FIG. 7 is a sectional view of a bottle having a vent system constructed and operative in accordance with a second embodiment of the present invention.
Figure 8:
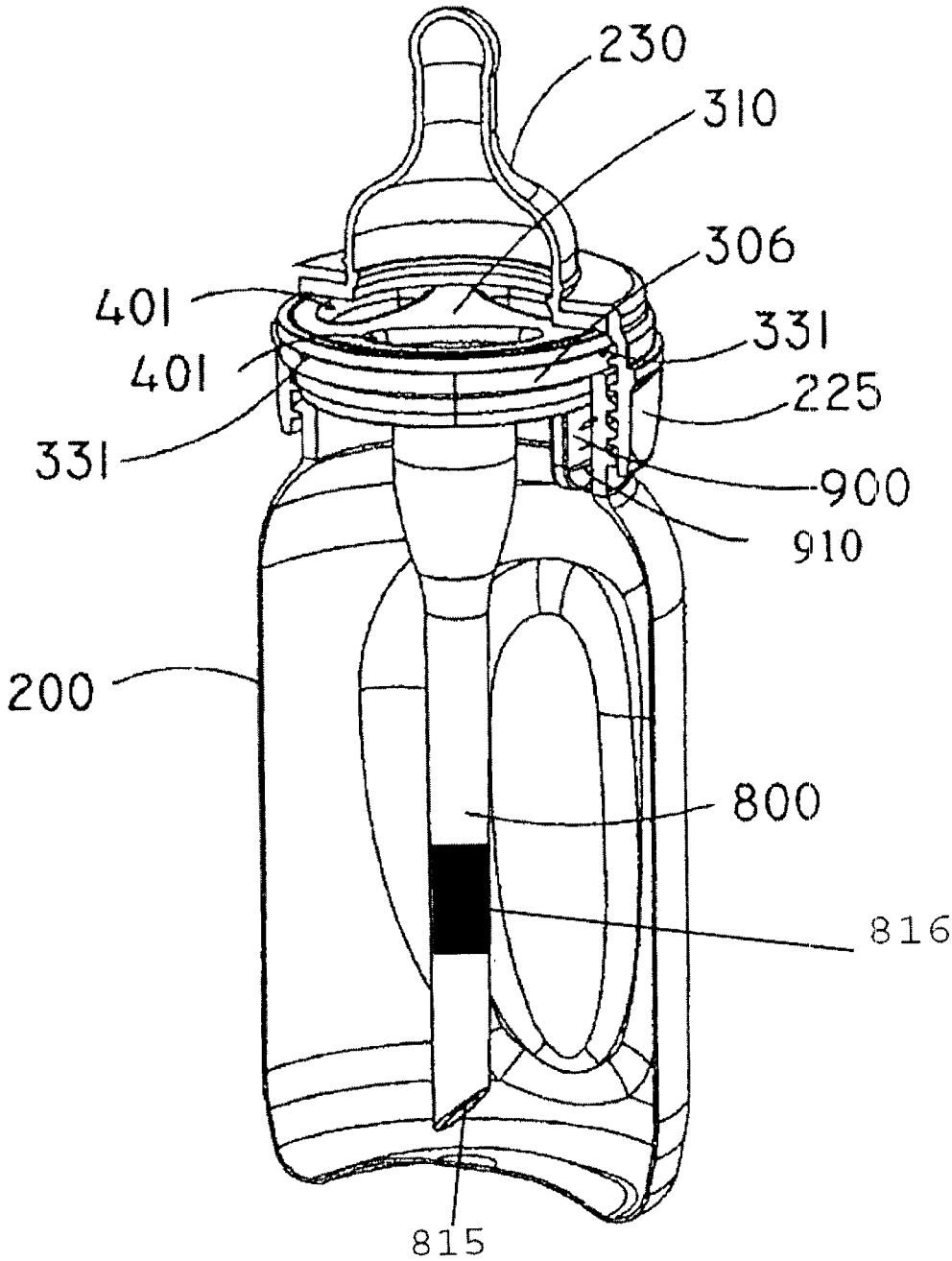
FIG. 8 is a partial sectional view of the bottle incorporating the vent system of the second embodiment.
Figure 9A:
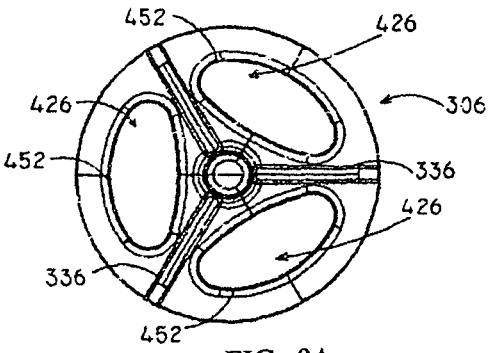
FIGS. 9A-9D are view of the base portion of a second embodiment of the invention.
Figure 9C:
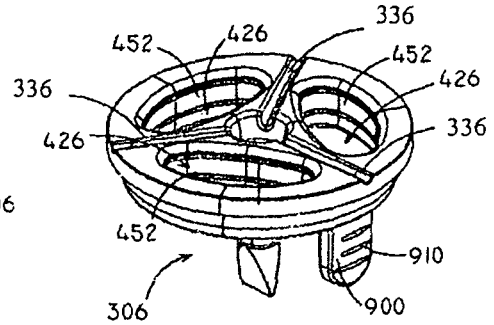
Figure 9B:
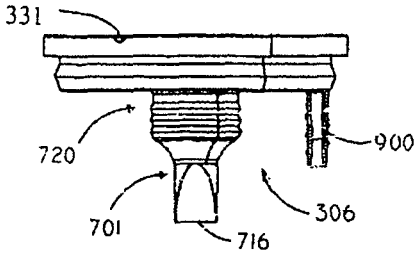
Figure 9D:
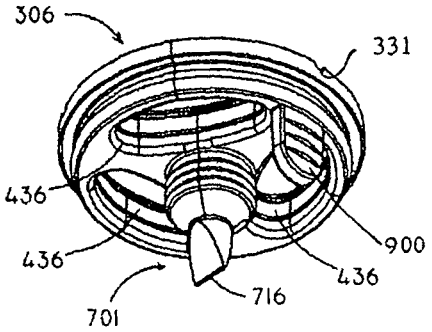
Figure 10:
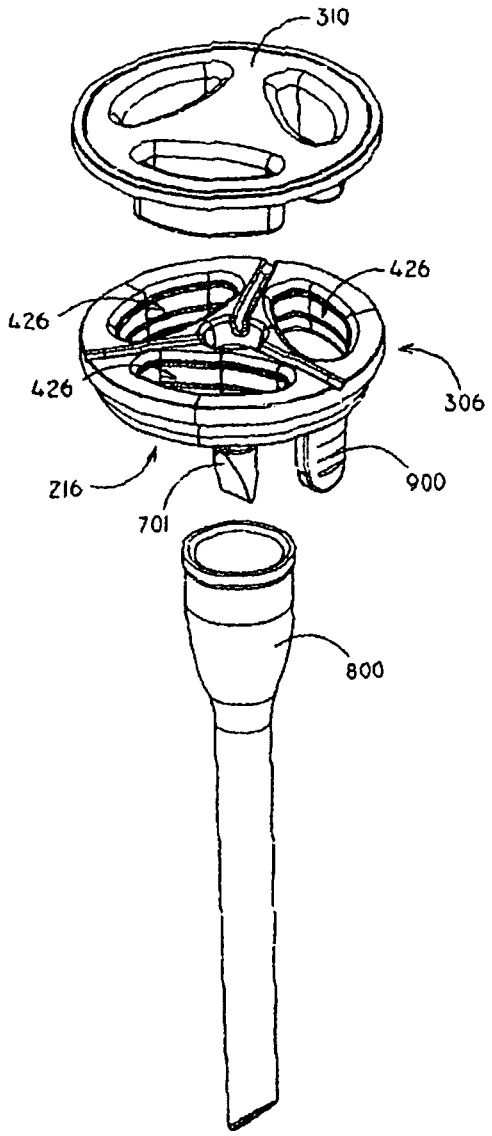
FIG. 10 is an exploded view of the vent system of the second embodiment.
Figure 11A:
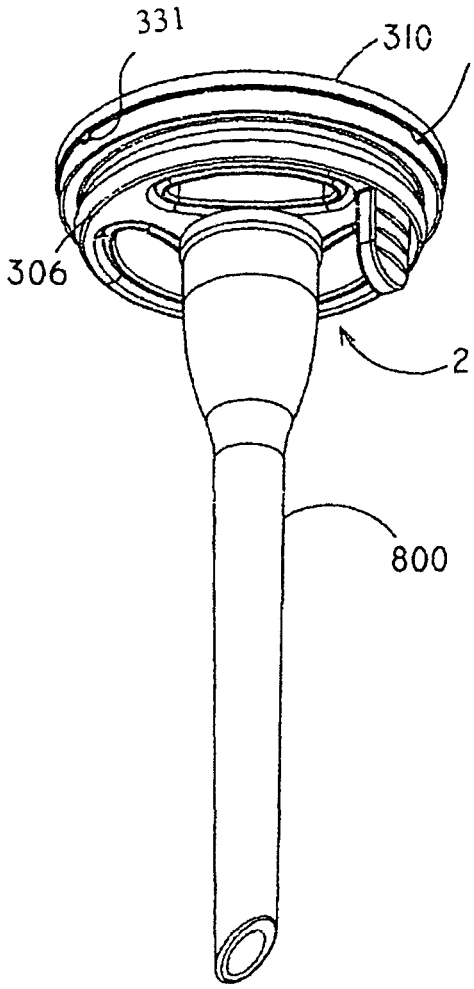
FIGS. 11A-11D are assembled views of the disc portion, the base portion of the second embodiment, and the anti-bubble tube.
Figure 11B:
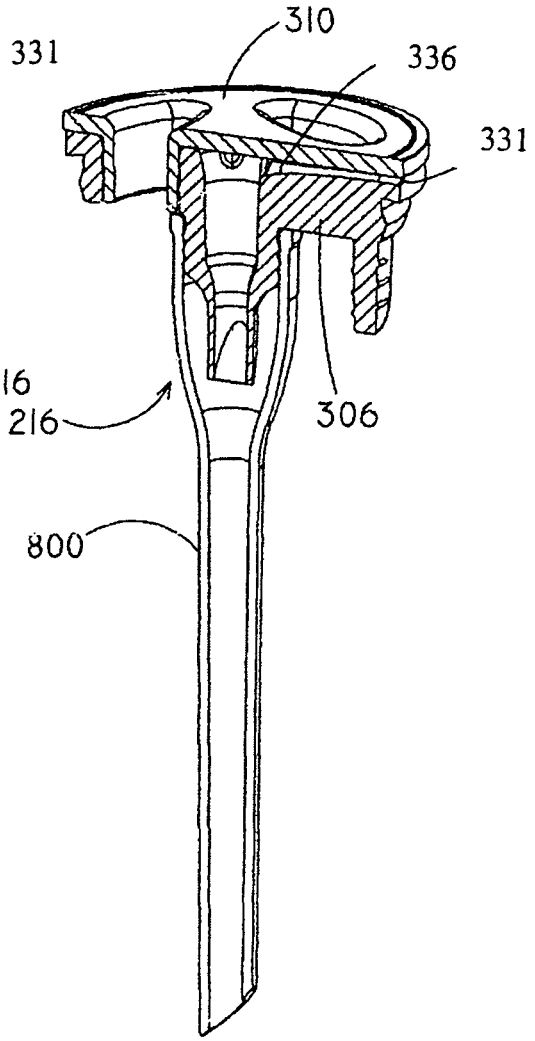
Figure 11C:
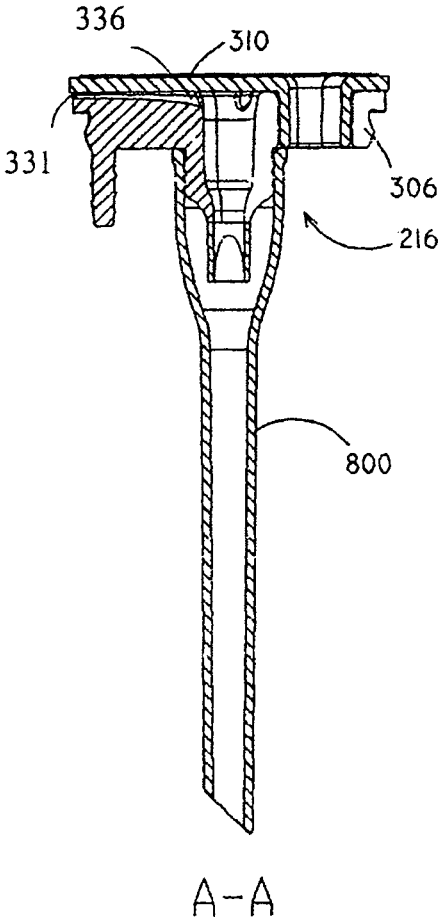
Figure 11D:
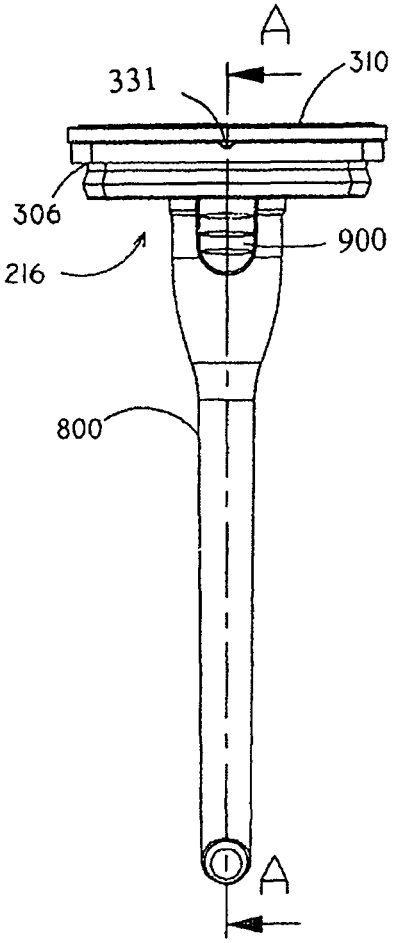

Referring now to FIGS. 7 and 8, there is shown a drinking container, here illustrated as a baby bottle, with a vent system 216 constructed and operative in accordance with an alternative embodiment of the invention. Vent system 216 includes a disc portion 310, identical to that discussed above, and a base portion 306. The vent system 216 functions in the same general manner as the vent system 215, and is shown with the container 200, the nipple 230, the collar 225, and the anti-bubble tube 800 illustrated above with the vent system 215. The vent system 216 includes liquid openings 401 to pass fluids to the nipple 230.

Integrally formed with base portion 306 is a one-way duck-bill valve 701 and a tab 900, as shown most clearly in FIGS. 9A to 9D. The duck-bill valve 701 is sensitive to fluctuations in pressure. The tab 900 provides the user a region to grasp on the base portion 306 when pulling or removing the anti-bubble tube 800 from the base portion 306. The tab 900 includes ridges 910 to provide a frictional gripping surface. In use, or during cleaning, the base portion 306 may be covered in a fluid such as milk or a cleaning solution, and it is helpful for the user to have the tab 900 to grasp and ease the removal of the anti-bubble tube from the base portion 306.

The incorporation of the duck-bill valve 701 into the base portion 306 provides a more sensitive valve. The duck-bill valve 701 has a slit 716 that forms an opening to allow air to enter the anti-bubble tube 800 and eventually into the container 200. The slit 716 has a generally linear shape which, preferably, is positioned in a direction generally perpendicular to the air entering the duck-bill valve 701 and pushing against the slit 716. This relationship promotes the sensitivity of the duck-bill valve 701. The duck-bill valve 701 is very sensitive to pressure and will open with only a few drops of liquid leaving the container 200 allowing air to enter the container 200. When liquid is no longer leaving the container 200, the duck-bill valve 701 closes fast to prevent leakage via the vent system 216. Also, the duck-bill valve 701 is open on its top side and will allow easy cleaning, since a cleaning solution may easily be introduced into the duck-bill valve 701.

Base portion 306 also includes integrally formed base vent channels 416 leading from air vent openings 331. The base vent channels 416 (shown in FIGS. 9A and 9B) are a grooved or a recessed portion in the top surface of the base portion 306 that create a channel for air to enter the base portion 306 from outside the container into the valve and thence to the interior of the container.

Base portion 306 also includes a plurality of base liquid openings 426. The base liquid openings 426 are defined by base liquid opening channels 452 that extend through the base portion 306. The base liquid opening channels 450 have a tubular shape to permit the free flow of liquid therethrough and are complementary to disc liquid openings 430 in the disc portion 310.

As seen in FIGS. 10 and 11A-11D, disc portion 310 and base portion 306 cooperate to form the vent system 216. Air vent channels 336 are formed by placing the planar lower surface of disc portion 310 over base vent channels 416 of the second base portion 306, as described above. Air vent channel openings 331 permit air to enter the air vent channels 336. The air vent channels 336 merge into the unidirectional duck-bill valve 701 to allow air to enter the container 200 when minimal vacuum is formed in the container.

The base liquid openings 426 and the disc liquid openings 430 of the disc portion 310 are complementary and their joining stabilizes the vent system 216. In particular, the descending member 431 of the disk portion 310 seals against a surface 436 of base liquid opening channels 452 of the second base portion 306. In this embodiment, the second base portion 306 comprises three base liquid openings 426. When the disc portion 310 is placed on the second base portion 306, the liquid openings 401 are sealed from the air vent channels 336 and provide passage for the liquid to the nipple 230.

The base portion 306 optionally includes an indented region 720 which allows the user to frictionally attach an anti-bubble tube 800 to the second base portion 306. The anti-bubble tube 800 fits securely over the indented region 720 and assists in maintaining the diving bell function since the anti-bubble tube seals the region surrounding the duck-bill valve 701. The four indents of the indented region 720 provide for the secure seal. Of course, fewer or additional indents may be used and still maintain a tight seal. However, four indents have shown to be effective in providing a secure seal, yet still provide for the anti-bubble tube 800 to be removable from the indented region 720.

In some embodiments, the anti-bubble tube 800 may include a heat sensor portion 816 (as shown in FIG. 8) produced from microencapsulated temperature sensitive plastics. These plastics use color change to indicate specific temperature changes of liquid inside the container.

It will be appreciated that the second base portion 306 may also be used without the anti-bubble tube 800 and still prevent leakage from inside the bottle through the air vent channels.

Figure 12:
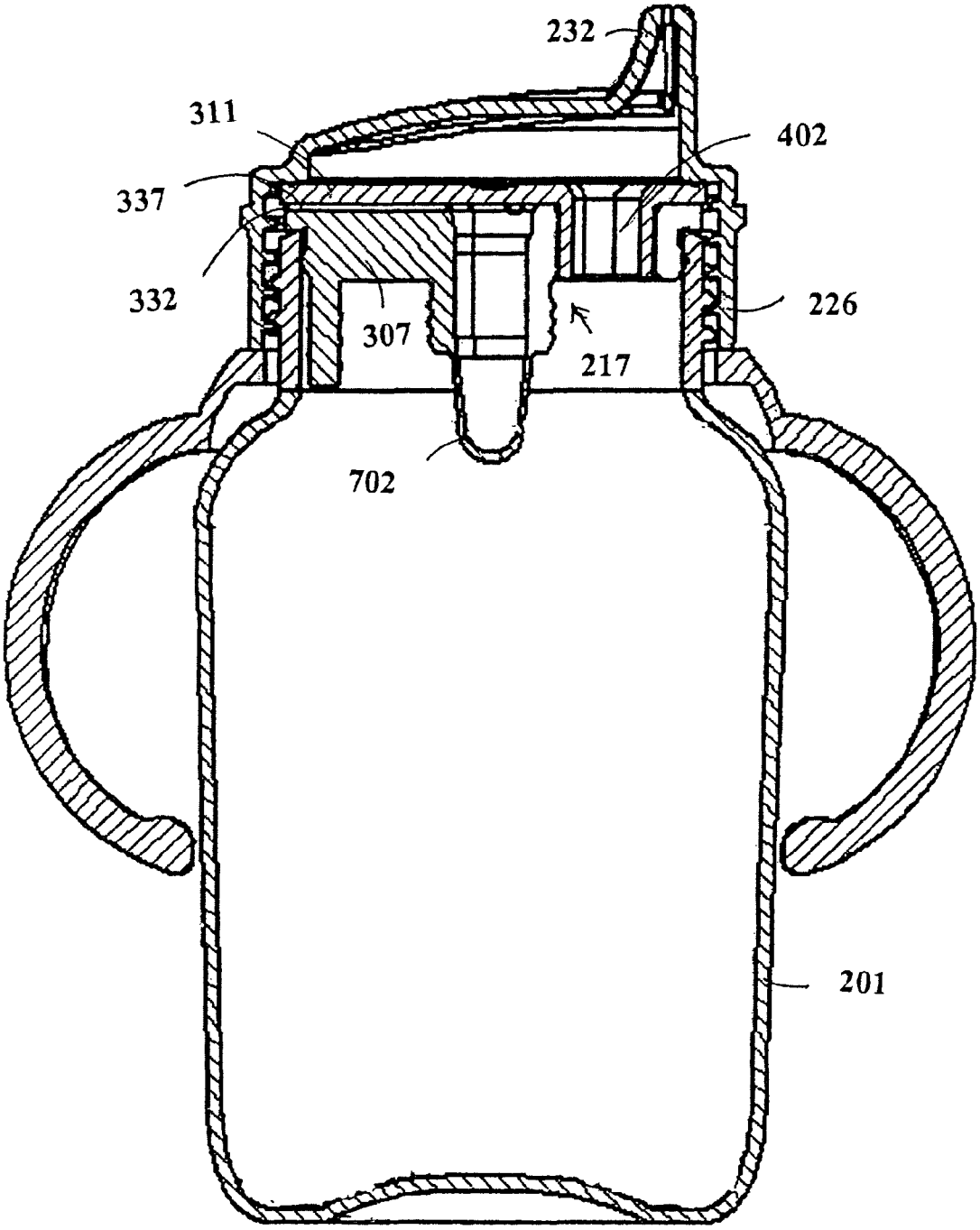
FIG. 12 is a sectional view of a sippy cup having a vent system constructed and operative in accordance with an embodiment of the present invention.

In general, the vent system of the first embodiment or the second embodiment may also be used with a sippy cup and held in place by a sippy cup collar 226 that threadably connects to the sippy cup, as shown, for example, in FIG. 12. The vent system 217 is substantially the same as for a baby bottle embodiment; however, one of ordinary skill in the art will readily be able to scale up the vent system to accommodate a larger sippy cup. The vent system 217 includes a disc portion 311 and a base portion 307 which cooperate, as described above, to provide liquid openings 402 for liquid flow from the container to the spout 232 of the sippy cup, and air vent channels 337 leading from air vent openings 332 to an integral valve 702. The venting of the sippy cup works in an identical fashion as to the baby bottle, i.e., as the child sucks and a minimal vacuum is created inside the container, air passes between the threaded regions of the sippy cup container and the sippy cup collar into air vent openings 332 and through valve 702 into the container.

The vent system may be made from a variety of plastic/rubber materials, such as silicone and thermoplastic rubber. An especially preferred material for the base portion of the vent system is silicone, since it is easy to clean and safe for use.

It is an aspect of the present invention that leak resistant drinking containers are provided that may be filled with hot water, and may be completely filled with liquid. In addition, these drinking containers may be used with thick, as well as thin, formulas. Furthermore, the apparatus of the present invention remains leak-free when the bottle is squeezed, if the nipple attached to the bottle is squeezed, when the bottle is shaken to mix a formula, if the liquid is heated to above 45° C., or if the bottle is subjected to changes in atmospheric pressure. Even in these situations, the liquid is prevented by the one-way valve from flowing out through the air inlet passages.

As evident from the foregoing description, the present invention is not limited by the particular details of the examples illustrated herein, and it is therefore contemplated that other modifications and applications, or equivalents thereof, will occur to those skilled in the art. It is accordingly attended that all claims shall cover all such modifications and applications that do not depart from the spirit and the scope of the present invention.

What is claimed is:

1. A vent system for drinking containers having a dispensing device and a collar coupling the dispensing device to the container, the vent system, comprising:

a substantially rigid disc portion having a substantially planar lower surface and a plurality of disc liquid openings comprising descending members;

a base portion formed of flexible material including a plurality of base vent grooves recessed in said base portion and extending between the periphery of said base portion and a single, integral uni-directional valve that, in an open position, allows air to enter the drinking container and, in a closed position, prevents liquid flowing out of the container into said base vent grooves, and further including a plurality of base liquid openings complementary to said descending members of said disk liquid openings; and wherein said descending members of said disc portion are received in and seal against a surface of said base liquid openings of said base portion and said disc portion and said base portion define air vent channels between said planar lower surface of the disc portion and said base vent grooves, leading from air vent openings in the exterior of said vent system and merging into said valve, allowing air to enter the container through said air vent channels and said valve.

2. The vent system according to claim 1, and further comprising an anti-bubble tube extending to nearly a bottom of portion of the container, said anti-bubble tube being releasably coupleable to said base portion and circumscribing said valve, wherein the anti-bubble tube traps a volume of air surrounding the valve when the valve is in a closed position, so as to create a "diving bell" effect within the anti-bubble tube.

3. The vent system according to claim 2, wherein said anti-bubble tube comprises a heat sensor of a thermally reactive material to indicate a temperature of a liquid in the container.

4. The vent system according to claim 2, wherein said anti-bubble tube has a lower section and an upper section, wherein the upper section generally surrounds the valve, and wherein the lower section has a larger volume than the upper section.

5. The vent system according to claim 1, wherein said base portion further comprises a tab for grasping on the base portion.

6. A drinking container having a dispensing device and a collar coupling the dispensing device to the container, the drinking container comprising:

a liquid container; and a vent system coupled to said liquid container, said vent system comprising:

a substantially rigid disc portion having a substantially planar lower surface and a plurality of disc liquid openings comprising descending members;

a base portion formed of flexible material including a plurality of base vent grooves extending between the periphery of said base portion and a single, integral uni-directional valve that, in an open position, allows air to enter the liquid container and, in a closed position, prevents liquid flowing out of the container into the base vent grooves, and further including a plurality of base liquid openings;

wherein said descending members of said disc portion are complementary to said base liquid openings and are received in and seal against a surface of said base liquid openings of said base portion, thereby forming liquid openings which allow liquid to exit the container and prevent liquid from entering into said base vent grooves; and wherein said disc portion and said base portion define air vent channels between said planar lower surface of the disc portion and said base vent grooves, leading from air vent openings in the exterior of said vent system and merging into said valve, allowing air to enter the container through said air vent channels and said valve.

7. The drinking container according to claim 6, wherein said dispensing device includes a nipple, wherein the collar is threadably connected to the container, and connecting said collar to said container seals said nipple against said vent system, and wherein air passes in between a threaded region of a neck of the bottle and a threaded region of said collar and air enters said air vent channel openings.

8. The drinking container according to claim 6, wherein said dispensing device includes a spout, wherein said collar is threadably connected to said container, and connecting said collar to said container seals said spout against said vent system, and wherein air passes in between a threaded region of a neck of the bottle and a threaded region of the collar and air enters said air vent channel openings.

9. The drinking container according to claim 6, and further comprising an anti-bubble tube extending to nearly a bottom of portion of said container, said anti-bubble tube being releasably coupleable to said base portion and circumscribing said valve, wherein said anti-bubble tube traps a volume of air surrounding said valve when said valve is in a closed position, so as to create a "diving bell" effect within said anti-bubble tube.

10. The drinking container according to claim 6, wherein said base portion further comprises a tab for grasping on the base portion.

11. A method for manufacturing a vent system for a drinking container having a dispensing device and a collar coupling the dispensing device to the container, the method comprising:

providing a substantially rigid disc portion having a substantially planar lower surface and a plurality of disc liquid openings comprising descending members;

forming a base portion of flexible material and forming in said flexible material a plurality of base vent grooves recessed in said base portion and extending between the periphery of said base portion and a single, integral uni-directional valve that, in an open position, allows air to enter the drinking container and, in a closed position, prevents liquid from flowing out of the container into the base vent grooves, and further forming in said base portion a plurality of base liquid openings complementary to said descending members; and coupling said disc portion to said base portion by sealingly seating said descending members inside said base liquid openings, thereby forming air vent channels between said planar lower surface of the disc portion and said base vent grooves, leading from air vent openings in the exterior of said vent system and merging into said valve, allowing air to enter said container through said air vent channels and said valve, wherein said descending members of said disc portion are received in and seal against a surface of said base liquid openings of said base portion, thereby forming liquid openings which allow liquid to exit the container and prevent liquid from entering into said air vent channels.

12. The method according to claim 11, and further comprising releasably coupling an anti-bubble tube to said base portion and circumscribing said valve, said anti-bubble tube extending to nearly a bottom of portion of said container, wherein said anti-bubble tube traps a volume of air surrounding said valve when said valve is in a closed position, so as to create a "diving bell" effect within said anti-bubble tube.

13. The method according to claim 11, further comprising forming a tab on said base portion for grasping on the base portion.

* * * * *